US006705232B2

(12) United States Patent
Theurer et al.

(10) Patent No.: US 6,705,232 B2
(45) Date of Patent: Mar. 16, 2004

(54) MACHINE FOR TAMPING TIES OF A TRACK

(75) Inventors: Josef Theurer, Vienna (AT); Friedrich Peitl, Linz (AT)

(73) Assignee: Franz Plasser Bahnbaumaschinen-Industriegesellschaft m.b.H., Vienna (AU)

( * ) Notice: Subject to any disclaimer, the term of this patent is extended or adjusted under 35 U.S.C. 154(b) by 0 days.

(21) Appl. No.: 10/446,541

(22) Filed: May 28, 2003

(65) Prior Publication Data

US 2004/0003750 A1 Jan. 8, 2004

(30) Foreign Application Priority Data

Jul. 4, 2002 (AT) ..... 443/2002 U

(51) Int. Cl.[7] ..... E01B 27/16
(52) U.S. Cl. ..... 104/12; 104/7.1
(58) Field of Search ..... 104/2, 7.1, 7.2, 104/8, 10, 12

(56) References Cited

U.S. PATENT DOCUMENTS 3,595,170 A * 7/1971 Plasser et al. ..... 104/12
3,779,170 A * 12/1973 Plasser et al. ..... 104/12
4,430,946 A * 2/1984 Theurer et al. ..... 104/7.2
4,576,095 A * 3/1986 Theurer ..... 104/12
4,628,822 A * 12/1986 Theurer ..... 104/7.2
4,643,101 A * 2/1987 Theurer ..... 104/7.2
4,655,142 A 4/1987 Theurer et al. ..... 104/7.1
4,825,768 A * 5/1989 Theurer et al. ..... 104/7.2
4,893,565 A * 1/1990 Theurer et al. ..... 104/7.2
5,007,349 A * 4/1991 Theurer ..... 104/12
5,127,334 A * 7/1992 Theurer ..... 104/12
5,269,226 A * 12/1993 Theurer et al. ..... 104/12
5,299,505 A * 4/1994 Theurer et al. ..... 104/7.2
5,343,810 A * 9/1994 Theurer ..... 104/12
5,419,259 A * 5/1995 Theurer et al. ..... 104/7.2
5,477,787 A * 12/1995 Theurer et al. ..... 104/2
5,515,788 A 5/1996 Theurer et al. ..... 104/12
5,619,929 A * 4/1997 Theurer ..... 104/12

* cited by examiner

*Primary Examiner*—S. Joseph Morano
*Assistant Examiner*—Lars A. Olson
(74) *Attorney, Agent, or Firm*—Henry M. Feiereisen

(57) ABSTRACT

A tamping machine for tamping ballast underneath ties of a railroad track includes a machine frame extending in a longitudinal direction and supported for mobility on the track by two undercarriages. A subframe is arranged between the undercarriages and is mobile on the track by means of a further, separate undercarriage. A frame support is provided for connecting the subframe to the machine frame in a manner allowing displacement of the subframe in the longitudinal direction. The frame support is mounted on the machine frame and displaceable relative thereto perpendicularly to the longitudinal direction. A transverse drive is connected to the frame support and linked to the machine frame. A vertically adjustable tamping unit and a track lifting unit are arranged on the subframe between the further undercarriage and the frame support.

6 Claims, 2 Drawing Sheets

MACHINE FOR TAMPING TIES OF A TRACK

CROSS-REFERENCES TO RELATED APPLICATIONS

This application claims the priority of Austrian utility model application GM 443/2002, filed Jul. 4, 2002, the subject matter of which is incorporated herein by reference.

BACKGROUND OF THE INVENTION

The present invention relates, in general, to a tamping machine.

A track maintenance machine of this type is provided for tamping ballast underneath ties of a railroad track, and generally includes a machine frame, extending in a longitudinal direction and supported for mobility on the track by two undercarriages, and a tamping unit and a track lifting unit.

U.S. Pat. No. 4,655,142 and U.S. Pat. No. 5,515,788 disclose a tamping machine, with a subframe being arranged between two undercarriages of the machine frame and supported for mobility on the track by a further, separate undercarriage. A frame support connects the subframe to the machine frame in a manner allowing displacement of the subframe in the longitudinal direction. The vertically adjustable tamping unit and track lifting unit are arranged on the subframe between the further undercarriage and the frame support.

Tamping machines of this type can travel continuously during working operations, whereby the machine frame, which represents a major part of the total mass of the machine, does not have to be stopped at each tie to be tamped and then accelerated again immediately thereafter. This intermittent advance movement is limited only to the subframe, connected to the machine frame, which carries the working units and is designed for displacement relative to the machine frame.

It would be desirable and advantageous to provide an improved tamping machine which allows a tamping of track curve sections in a reliable manner.

SUMMARY OF THE INVENTION

According to one aspect of the present invention, a tamping machine for tamping ties of a track includes a machine frame extending in a longitudinal direction and supported for mobility on the track by two undercarriages; a subframe arranged between the said undercarriages and supported for mobility on the track by a further undercarriage; a frame support connecting the subframe to the machine frame in a manner allowing displacement of the subframe in the longitudinal direction, the frame support being mounted on the machine frame for displacement perpendicularly to the longitudinal direction; a transverse drive connected to the frame support and linked to the machine frame; and a vertically adjustable tamping unit and a track lifting unit arranged on the subframe between the further undercarriage and the frame support.

A tamping machine having a frame support designed in this way is particularly suited for tamping units which are adapted for tamping several ties of the track simultaneously. Owing to the transverse displaceability of the subframe it is now possible to center the tamping unit with respect to the rail in an optimal manner even in track curves.

BRIEF DESCRIPTION OF THE DRAWING

Other features and advantages of the present invention will be more readily apparent upon reading the following description of currently preferred exemplified embodiments of the invention with reference to the accompanying drawing in which.

DETAILED DESCRIPTION OF PREFERRED EMBODIMENTS

Figures 1, 3, 5, 6:
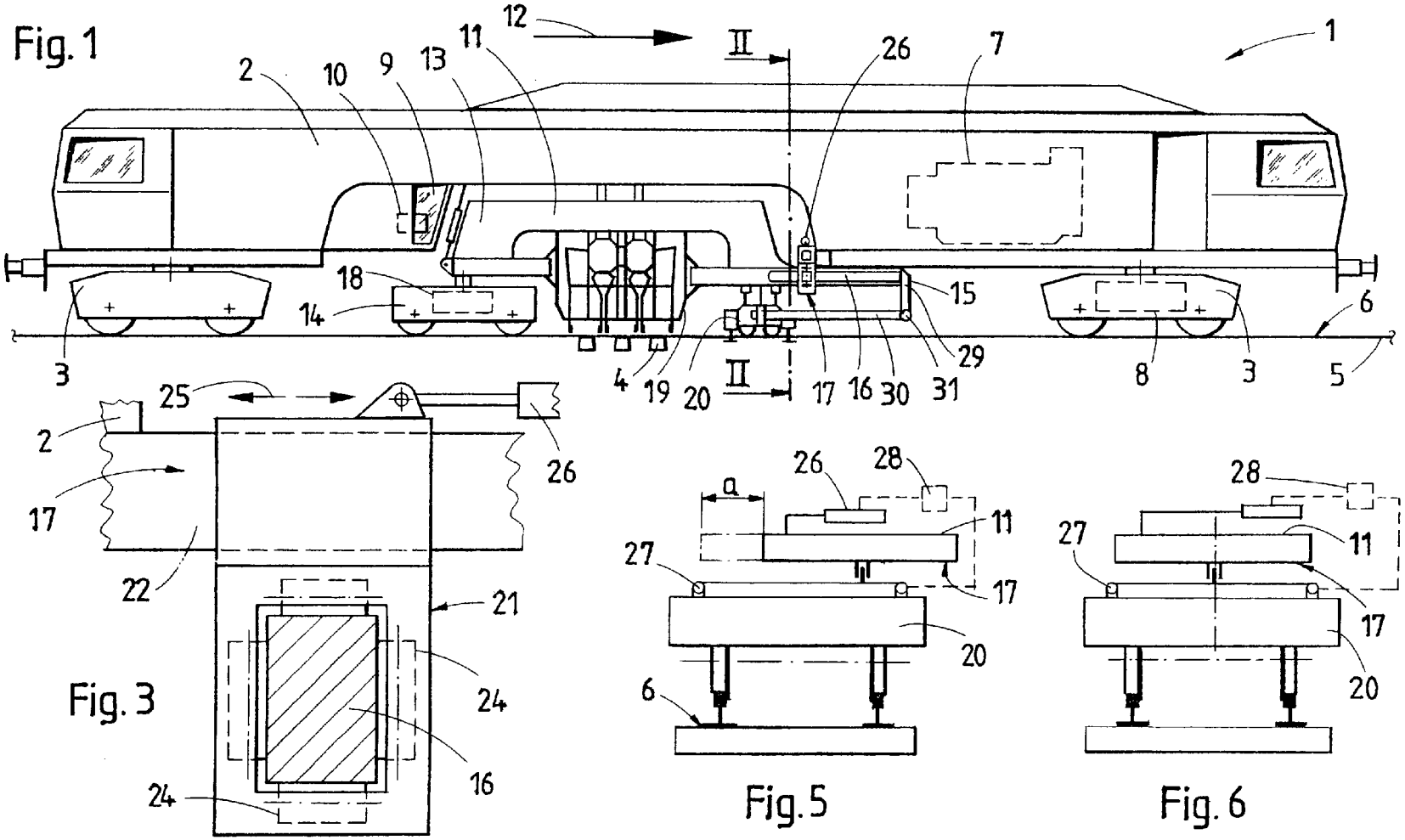
FIG. 1 is a simplified side view of a tamping machine according to the invention.
FIG. 3 is an enlarged cross-section of a different variant of a connection of the subframe to the machine frame.
FIGS. 5 and 6 are respective schematic views in the longitudinal direction, showing the track lifting unit and the frame support in different positions during operation.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a simplified side view of a tamping machine according to the invention, generally designated by reference numeral 1 and including a machine frame 2 which extends in a longitudinal direction and is equipped at both ends with a respective undercarriage 3. The machine 1 is provided with a motor 7 and a motive drive 8 and is thereby mobile on a track 6 in an operating direction 12, with the track 6 composed of ties 4 and rails 5. A control device 10 is located in a work cabin 9 of the machine 1.

Arranged between the two undercarriages 3 of the machine frame 2 is a subframe 11 which has a front end 15 and a rear end 13 with regard to the operating direction 12. The rear end 13 is supported on the track 6 by means of a further, separate undercarriage 14 having a separate motive drive 18. Provided at the front end 15 of the subframe 11 are two frame beams 16, spaced from one another transversely to the longitudinal direction and arranged in opposite relationship, which are supported on the machine frame 2 in a frame support 17 allowing for longitudinal displacement of the subframe 11 relative to the machine frame 2. Immediately in front of the further undercarriage 14 of the subframe 11, a tamping unit 19 is provided which is designed for simultaneously tamping three ties 4 of the track 6. A track lifting unit 20 precedes the tamping unit 19 in the operating direction 12, with both, the tamping unit 19 and the track lifting unit 20, being connected to the subframe 11 for vertical adjustment.

Figure 2:
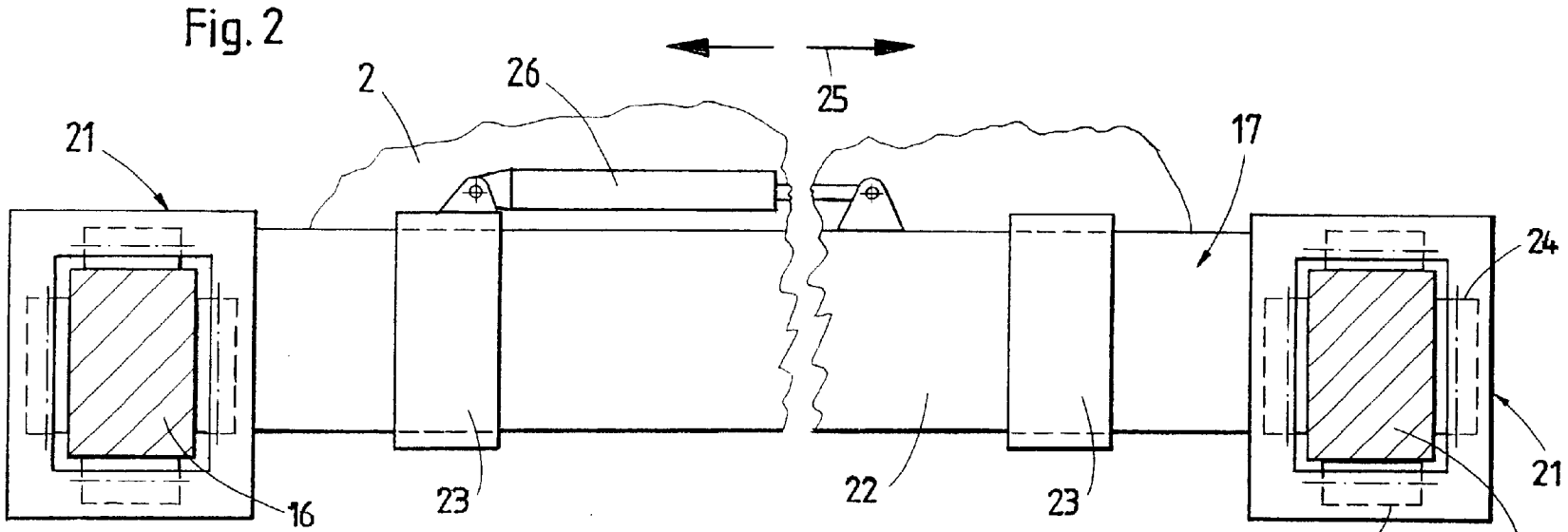
FIG. 2 is an enlarged cross-section along section line II—II of the machine show in FIG. 1.

As can be seen more clearly in FIG. 2, the frame support 17 includes two glide bearings 21 spaced from one another transversely to the longitudinal direction and connected to one another by a transverse yoke 22. The glide bearings 21 are each equipped with slide rollers 24 to enable a displacement of the frame beams 16, supported therein, in the longitudinal direction. The transverse yoke 22, in turn, is supported for transverse. displacement in slide mounts 23 connected to the machine frame 2. The frame support 17 is thus displaceable in a transverse direction, indicated by arrow 25, of the machine 1 relative to the machine frame 2. To execute the displacement, a transverse drive 26 is provided which is articulated, on the one hand, to the machine frame 2 (or the slide mount 23) and, on the other hand, to the transverse yoke 22.

The two frame beams 16, spaced from one another transversely of the longitudinal direction, are connected to one another by means of a transverse beam 29 to which a push rod 30 is articulated by means of a universally acting joint 31. The push rod 30 is further connected to the track lifting unit 20. With regard to the longitudinal or operating direction 12, the glide bearings 21 are arranged between the transverse beam 29 and the track lifting unit 20 (see FIG. 1).

FIG. 3 shows an alternative embodiment of a frame support 17, in which the glide bearings 21—supporting the frame beams 16—are mounted for transverse displacement on the transverse yoke 22 which, in turn, is connected at its ends to the machine frame 2.

Figure 4:
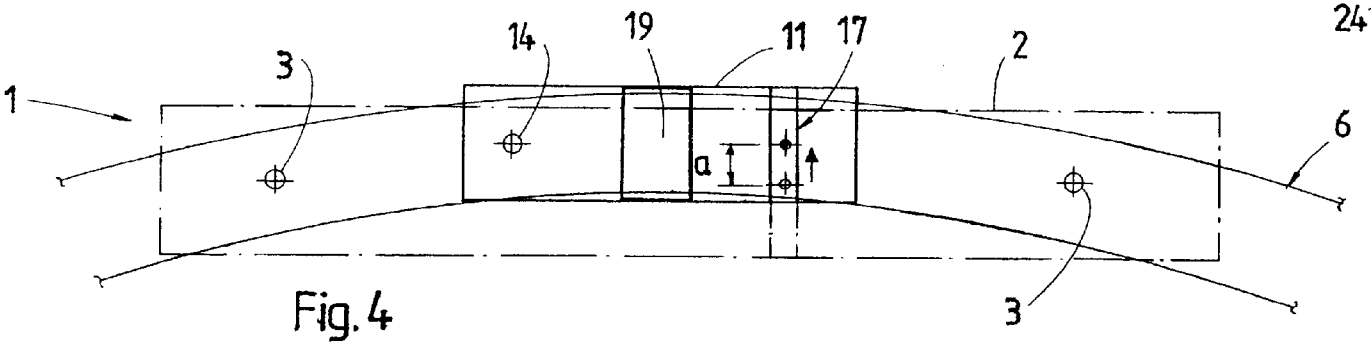
FIG. 4 is a schematic top view of the tamping machine.

As can be seen in FIG. 4, the transverse displacement of the frame support 17 and thus also the subframe 11 assures that the tamping unit 19 can be best suited to the course of the track 6 even in a track curve, in order to thereby guarantee an optimum tamping result.

In FIGS. 5 and 6, a control device 28 is shown which is connected to the transverse drive 26 and also to a measuring device 27. The measuring device 27 which is designed as a tensioned cable potentiometer is fastened to the track lifting unit 29 and serves to detect a transverse displacement path, indicated by reference character "a", of the frame support 17 relative to the track lifting unit 20. Of course, it is also be possible to use a measuring device 27 which operates in a non-contact manner.

As soon as a transverse displacement path "a" is detected by the measuring device 27, when the machine 1 is situated in a track curve (see FIG. 5), the transverse drive 26 is automatically actuated by the control device 28. This causes a transverse displacement of the subframe 11 until the frame support 17 is again positioned centrally above the track lifting unit 20 (or the track 6 in the region of the frame support 17), and the transverse displacement path "a" has the value zero (see FIG. 6).

While the invention has been illustrated and described as embodied in a machine for tamping ties of a track, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed is:

1. A tamping machine for tamping ties of a track, comprising:

a machine frame extending in a longitudinal direction and supported for mobility on the track by two undercarriages;

a subframe arranged between the undercarriages and supported for mobility on the track by a further undercarriage;

a frame support connecting the subframe to the machine frame to allow displacement of the subframe in the longitudinal direction, said frame support being mounted on the machine frame for displacement perpendicularly to the longitudinal direction;

a transverse drive connected to the frame support and linked to the machine frame; and a vertically adjustable tamping unit and a track lifting unit arranged on the subframe between the further undercarriage and the frame support.

2. The machine of claim 1, wherein the frame support has two slide mounts disposed in spaced-apart relationship transversely to the longitudinal direction and connected to the machine frame, and further comprising two frame beams extending in the longitudinal direction and connected to the subframe, and a transverse yoke slidably mounted to the slide mounts for transverse displacement and including two glide bearings in spaced-apart relationship transversely to the longitudinal direction to support the frame beams for displacement in longitudinal direction.

3. The machine of claim 1, and further comprising a measuring device, connected to the transverse drive and to a control device, for detecting a transverse displacement path.

4. The machine of claim 3, wherein the measuring device is designed for detecting a displacement, transversely to the longitudinal direction, of the frame support relative to the track lifting unit.

5. The machine of claim 2, wherein the two frame beams are spaced from one another transversely to the longitudinal direction, said subframe including a transverse beam which connects the two frame beams, and further comprising a push rod connected to the track lifting unit and articulatedly linked to the transverse beam by means of a universally acting joint.

6. The machine of claim 5, wherein the glide bearings are arranged between the transverse beam and the track lifting unit, with regard to the longitudinal direction.

* * * * *